US008014546B2

(12) United States Patent
Lurvink et al.

(10) Patent No.: US 8,014,546 B2
(45) Date of Patent: Sep. 6, 2011

(54) EMI SHIELDING FOR A MICROPHONE

(75) Inventors: Rene Lurvink, Geldrop (NL); Martien Kas, St. Willebrord (NL); Marc Smaak, Bergen op Zoom (NL); Ad Hermans, Chaam (NL)

(73) Assignee: Robert Bosch GmbH, Stuttgart (DE)

( * ) Notice: Subject to any disclaimer, the term of this patent is extended or adjusted under 35 U.S.C. 154(b) by 876 days.

(21) Appl. No.: 11/326,054

(22) Filed: Jan. 5, 2006

(65) Prior Publication Data

US 2006/0162996 A1 Jul. 27, 2006

(30) Foreign Application Priority Data

Jan. 26, 2005 (EP) ..... 05100488

(51) Int. Cl.

| | |
|---|---|
| ***H04R 25/00*** | (2006.01) |
| *H04R 1/02* | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl. ..... 381/189; 381/91; 381/355; 381/361; 381/363; 381/369

(58) Field of Classification Search ..... 381/189, 381/91, 355, 361, 363, 369
See application file for complete search history.

(56) References Cited

U.S. PATENT DOCUMENTS

| | | | | |
|---|---|---|---|---|
| 4,993,072 | A | 2/1991 | Murphy | |
| 6,097,613 | A * | 8/2000 | Batten et al. | 361/816 |
| 7,351,479 | B2 * | 4/2008 | Funkenbusch et al. | 428/626 |
| 2002/0106091 | A1 | 8/2002 | Furst et al. | |

FOREIGN PATENT DOCUMENTS

| | | |
|---|---|---|
| EP | 0 660 642 | 6/1995 |
| WO | 2004/017700 | 2/2004 |

* cited by examiner

*Primary Examiner* — Davetta Goins
*Assistant Examiner* — Matthew Eason
(74) *Attorney, Agent, or Firm* — Michael J. Striker

(57) ABSTRACT

A microphone has at least one non-conductive component with at least one side covered by a metal layer which in turn is covered by a protective layer, and the microphone can be a component of a delegate unit of a conference system or a congress system.

9 Claims, 3 Drawing Sheets

EMI SHIELDING FOR A MICROPHONE

CROSS-REFERENCE TO A RELATED APPLICATION

The invention described and claimed hereinbelow is also described in European Patent Application EP 05100488.5 filed on Jan. 26, 2005. This European Patent Application, whose subject matter is incorporated here by reference, provides the basis for a claim of priority of invention under 35 U.S.C. 119(a)-(d).

BACKGROUND OF THE INVENTION

This invention relates to a microphone.

GSM interference is a problem for a lot of electronic products. The commonly known solution is ether a shielding by a metal cabinet or short circuit the high frequency signal by a capacitor. For a microphone both methods have it drawbacks, because metal shielding limits the modelling possibilities of the microphone. Placing a capacitor only works if it is very close to the semiconductor component in the microphone. Due to the high frequency of GSM systems or other wireless networks a capacitor is not effective enough.

US 2002/0106091 A1 discloses a microphone assembly casing, wherein said casing is a metallized non-conductive material, such as metal particle-coated plastics.

SUMMARY OF THE INVENTION

The advantage of the microphone that is the object of the present invention is the following. The proposed shielding by a metal layer and the protection of the metal layer by a protective layer have the advantage, that such a shielding is cheap, because such a shielding can be placed on plastic in a low-cost way. Furthermore this keeps the modelling possibilities, for example the modelling possibilities of the housing of the microphone, equal to a not shielded microphone. The protective layer has the advantage that the metal layer is protected against mechanical and/or chemical influences.

Aluminium is advantageous, because of its low cost, ease of sputtering and high adhesion to plastics. Furthermore aluminium has the advantage, that its conductivity is high. Chrome has the advantage, that it has an improved appearance and also a high corrosion resistance.

Further advantages are derived from the features cited in the further dependent claims and in the description.

An exemplary embodiment of the invention is shown in the drawing and described in further detail in the ensuing description.

DESCRIPTION OF THE PREFERRED EMBODIMENTS

In the following a microphone is described. The microphone comprises at least one non-conductive component, wherein at least one side of said non-conductive component is covered by a metal layer, characterised in that said metal layer is covered by a protective layer. The microphone is a component of a delegate unit of a conference system or a congress system.

In the following an aluminium coating is added to all plastic components of a microphone housing for shielding purposes. This coating is also used to give the microphone an expensive look. It can also be covered with paint of any color, so that the microphone design can be adapted very easily to the environment. To avoid corrosion of the very thin aluminium layer an additional protective layer is placed. This protective layer isolates the different plastic components from each other. However because of the high frequency of interference signal and the very thin layers the combination works as a capacitor. Therefore, if the plastic components have some overlap to each other the electrical contact will be enough. The larger the overlap area the lower the frequency it can shield.

Figure 1:
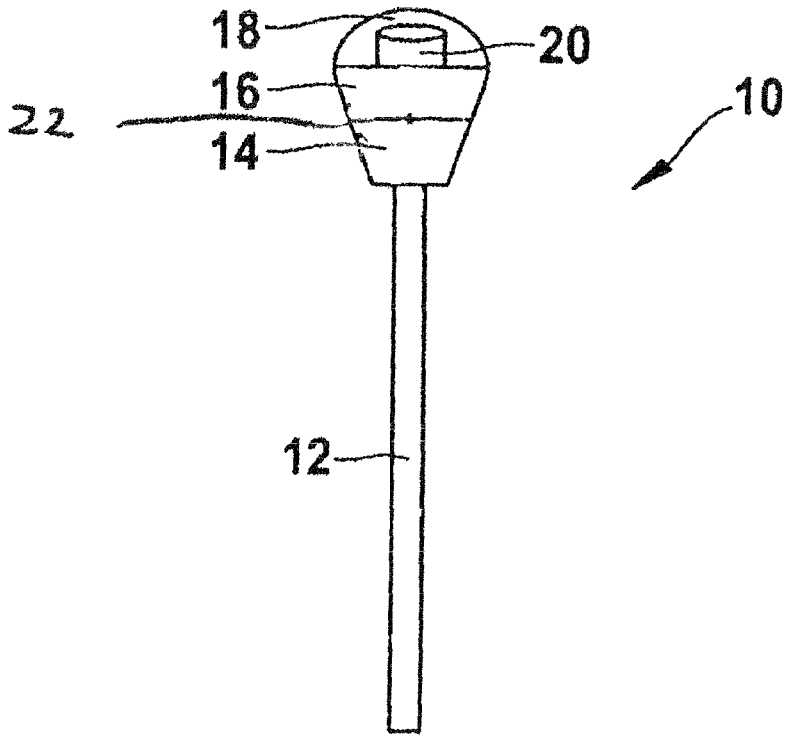
FIG. 1 shows a microphone.

FIG. 1 shows a microphone 10, comprising a stem 12, non-conductive components 14, 16, 18 of the housing and a microphone capsule 20. The housing of the microphone 10 is composed of a first non-conductive component 14, a second non-conductive component 16 and a third non-conductive component 18. The first non-conductive component 14 and the second non-conductive component 16 work as a windshield, wherein the third non-conductive component works as a plop shield. The stem is made of metal, e.g. aluminium or copper.

The first non-conductive component (14) and the second non-nonconductive component (16) adjoin one another at a contact point (22).

Figure 2:
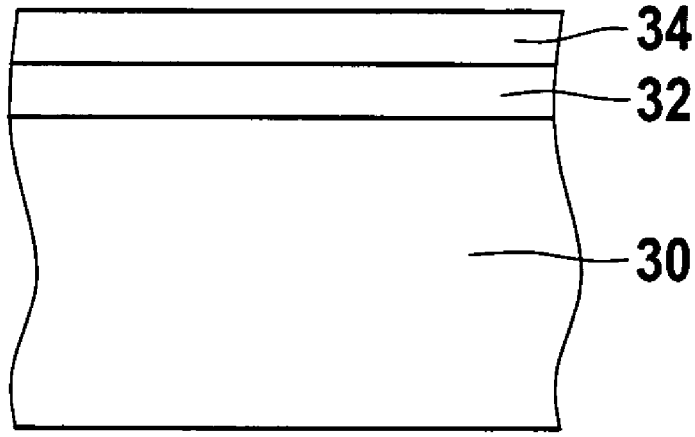
FIG. 2 shows a cross section view.

FIG. 2 shows a cross section view of one of the non-conductive components 14, 16, 18 shown in FIG. 1. In the preferred embodiment the non-conductive components are made of plastic 30, wherein said non-conductive components are covered by a metal layer 32, wherein said metal layer is covered by a protective layer 34. The metal layer 32 and the protective layer 34 are in the outer face of the microphone. In another embodiment the metal layer 32 and the protective layer 34 is in the inside of the microphone and/or in the outer face of the microphone.

The thicknesses of the metal layer and/or the protective layer is only a few micro meters (10-15 μm). The thickness itself does not matter as long as the complete surface is covered with material.

The metal layer is added by known methods of sputtering, vacuum metallisation and/or lacquering. The protective layer is added by a spraying technique for paint.

Figure 3:
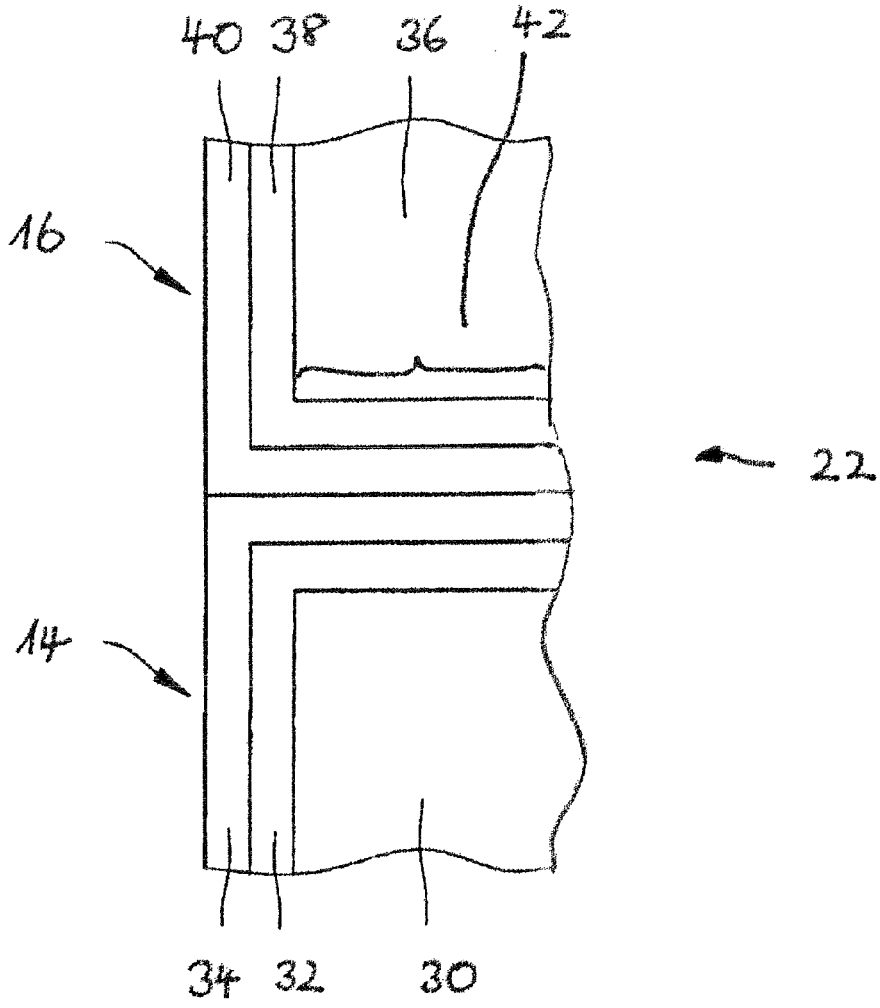
FIG. 3 shows a cross section view.

FIG. 3 shows a cross section view of the contact point of the first non-conductive component 14 and the second non-conductive component 16 shown in FIG. 1. The first non-conductive component 14 is made of plastic 30, wherein it is covered by, a metal layer 32. Said metal layer is covered by a protective layer 34. The second non-conductive component 14 is also made of plastic 36, wherein it is covered by a metal layer 38.

Said metal layer is covered by a protective layer 40. As material of the protective layer transparent and/or colored paint is used. The metal layer 32 of the first non-conductive component 14 and the metal layer 38 of the second non-conductive component 16 overlap partly, wherein the protective layer 34 of the first non-conductive component 14 and the protective layer 40 of the second non-conductive component 16 isolates the metal layers 32, 38 electrically.

The overlap of the metal layer (32) of the first non-conductive component (14) and the metal layer (38) of the second non-conductive component (16) is shown in FIG. 3 and identified with reference numeral (42).

As plastic all kind of plastic can be used, especially V2 type material or HB.

The metal layer 32 of the first non-conductive component 14, the protective layers 34, 40 and the metal layer 38 of the second non-conductive component 16 works as a capacitor. Therefore for high frequencies the metal layers 32, 38 are electrically connected.

The metal stem is connected to the system ground. This indirectly connects also the metal layer to the system ground.

The metal stem and/or other parts of the microphone and the metal layer are electrically connected. The connection is capacitive with an isolator (protective layer).

In the preferred embodiment the metal layers are made of or comprises aluminium and/or titanium and/or chrome. Further alternatives are conductive plastics. Conductive plastics are plastics which contain a large number of metal grain.

The actual shape of the overlap area shown in FIG. 3 differs depending on the component shape.

The invention claimed is:

1. Microphone, comprising at least one first non-conductive microphone component and at least one second separate non-conductive microphone component arranged over one another, wherein at least a part of each of said non-conductive microphone components is covered on an outer face by a metal layer, wherein each of the metal layers of each of said non-conductive microphone components has a first portion and a second portion arranged perpendicularly to one another and the metal layers are arranged so that the first portions of said metal layers of said non-conductive microphone components extends toward each other while the second portions of said metal layers of said non-conductive microphone components extend along one another, wherein said metal layers of said non-conductive microphone components are covered by a protective layers, and wherein said protective layers isolate the metal layers of said non-conductive microphone components electrically and are transparent.

2. Microphone according to claim 1, wherein said microphone comprises a housing, wherein said housing is composed of the non-conductive microphone components.

3. Microphone according to claim 1, wherein said non-conductive microphone components are made of plastic.

4. Microphone according to claim 1, wherein said metal layers comprise aluminum.

5. Microphone according to claim 1, wherein said metal layers comprise titanium and/or chrome.

6. Microphone according to claim 1, wherein the metal layers with the protective layers of said microphone components operate as a capacitor, so that high frequencies of the metal layers are electrically connected.

7. A microphone according to claim 1, wherein said microphone has a stem and is configured as a microphone of a delegate unit of a conference system.

8. A delegate unit of a conference system, comprising a microphone as defined in claim 1.

9. Microphone according to claim 1, wherein said non-conductive microphone components are separated from one another by said metal layers and by said protective layers arranged in a sequence consisting of one of said metal layers, one of said protective layers, another of said protective layers, another of said metal layers following each other.

* * * * *